US005528009A

United States Patent [19]

Marquardt et al.

[11] Patent Number: 5,528,009

[45] Date of Patent: Jun. 18, 1996

[54] VACUUM SWITCH WITH A CURRENT-LOOP ASSEMBLY

[75] Inventors: Ulrich Marquardt; Günter Prietzel, both of Berlin, Germany

[73] Assignee: Siemens Aktiengesellschaft, München, Germany

[21] Appl. No.: 307,820

[22] PCT Filed: Mar. 12, 1993

[86] PCT No.: PCT/DE93/00242

§ 371 Date: Sep. 27, 1994

§ 102(e) Date: Sep. 27, 1994

[87] PCT Pub. No.: WO93/20571

PCT Pub. Date: Oct. 14, 1993

[30] Foreign Application Priority Data

Mar. 27, 1992 [DE] Germany ..... 42 10 714.8

[51] Int. Cl.[6] ..... H01H 33/66; H01H 3/00; H01H 33/42

[52] U.S. Cl. ..... 218/140; 218/121; 335/195

[58] Field of Search ..... 218/10, 22, 30, 218/32, 121, 123, 126–129, 140, 120, 153, 154, 42

[56] References Cited

U.S. PATENT DOCUMENTS

| | | | |
|---|---|---|---|
| 3,663,906 | 5/1972 | Barkan et al. | 335/195 |
| 3,921,109 | 11/1975 | Hodgson | 335/195 |
| 4,247,745 | 1/1981 | Wilson | 218/140 |
| 4,591,679 | 5/1986 | Yamat et al. | 218/140 |

FOREIGN PATENT DOCUMENTS

| | | | |
|---|---|---|---|
| 0397294 | 11/1990 | European Pat. Off. | H01H 33/66 |
| 1343823 | 10/1963 | France | H01H 1/54 |
| 1132639 | 12/1959 | Germany | H01H 1/54 |
| 2049393 | 4/1971 | Germany | H01H 33/66 |
| 7241723 | 4/1973 | Germany | H01H 1/50 |
| 1640230 | 8/1975 | Germany | H01H 33/66 |
| 2429983 | 8/1976 | Germany | H01H 1/50 |
| 2450424 | 8/1985 | Germany | H01H 1/54 |
| 3414016 | 10/1985 | Germany | H01H 33/66 |
| 3432086 | 3/1986 | Germany | H01H 1/54 |
| 8905949 U | 10/1990 | Germany | H01H 33/66 |
| 0518816 | 10/1976 | U.S.S.R. | H01H 33/66 |
| 1217484 | 12/1970 | United Kingdom | H01H 33/66 |
| 1307991 | 2/1973 | United Kingdom | H01H 33/66 |
| 1348130 | 3/1974 | United Kingdom | H01H 33/66 |
| 2030777 | 4/1980 | United Kingdom | H01H 33/66 |

*Primary Examiner*—J. R. Scott
*Attorney, Agent, or Firm*—Kenyon & Kenyon

[57] ABSTRACT

A vacuum switch has a vacuum interrupter which can be actuated by a drive device using a lever arrangement. A two-armed drive lever is mounted in a pivotable fashion on the displaceable connection bolt of the vacuum interrupter and interacts with a stop face against which the drive lever can be rested by a contact spring. In order to compensate contact-breaking forces, a loop-shaped, flexible strip conductor is used which is arranged between the two legs of the drive lever in such a way that one leg of the strip conductor rests on a central part of the drive lever while the other leg is supported in a fixed manner. The current-loop and lever assembly is suitable for the construction of compact power switches.

2 Claims, 4 Drawing Sheets

VACUUM SWITCH WITH A CURRENT-LOOP ASSEMBLY

BACKGROUND OF THE INVENTION

The present invention relates to a vacuum switch including a vacuum interrupter having a displaceable connection bolt, and a drive device and a lever arrangement assigned to the vacuum interrupter, for connecting the common drive device to the vacuum interrupter. The lever arrangement has a two-armed drive lever which is connected in an articulated fashion to the displaceable connection bolt. On one side of the displaceable connection bolt the drive lever is connected to the drive device and interacts on the other side of the displaceable connection bolt with a fixed counter bearing, in addition with a contact spring and a current-loop assembly, formed from a flexible strip conductor, for obtaining a force which increases the contact force of the vacuum interrupter as a function of the current.

A vacuum switch slightly similar to that described above has been disclosed by German Patent Document No. DE-B-24 50 424. The vacuum switch described in this publication is a three pole protector in which the current-loop assembly serves, in the correctly switched on state, to increase the contact force as a function of current and to enlarge the opening force during switching off in order to break apart possible fusing of the switching elements. The current-loop assembly forms an independent assembly whose spatial requirement is approximately equal to the spatial requirement of the two-armed drive lever.

SUMMARY OF THE INVENTION

Taking the above vacuum switch as a point of departure, the present invention is based on substantially reducing the spatial requirement of the lever and current-loop assembly in order to facilitate the construction of compact switching devices.

This is achieved according to the present invention in that the fixed bearing is designed as a stop face against which the drive lever can be rested by the contact spring, the contact spring being designed as a tension spring and being arranged between an end part, which protrudes beyond the stop face, of the drive lever and a fixed counter bearing. One leg of the flexible strip conductor is connected to the displaceable connection bolt and is arranged to rest in a force-transmitting manner on the drive lever, including its end part, while the other leg of the strip conductor is supported in a fixed manner. In this way, it is ensured that the drive lever and the strip conductor form an associated assembly with correspondingly reduced spatial requirement. The contact spring acts at the same time as a switch-off spring during the release of its end connected to the drive device. The common use of a spring as a contact spring and as a switch off spring is known per se in vacuum switches from German Patent Document No. DE-A-34 14 016.

According to a further embodiment of the present invention, the drive lever can have two legs which receive the strip conductor between them and a central part which connects the legs and serves as a support face for supporting the leg, connected to the displaceable connection bolt, of the strip conductor. This design combines a high degree of rigidity of the drive lever with a good degree of protection of the strip conductor against lateral deformation.

BRIEF DESCRIPTION OF THE DRAWINGS

The present invention is explained in greater detail below with reference to the exemplary embodiment illustrated in the figures.

FIG. 3 is composed.

DETAILED DESCRIPTION

Figure 1:
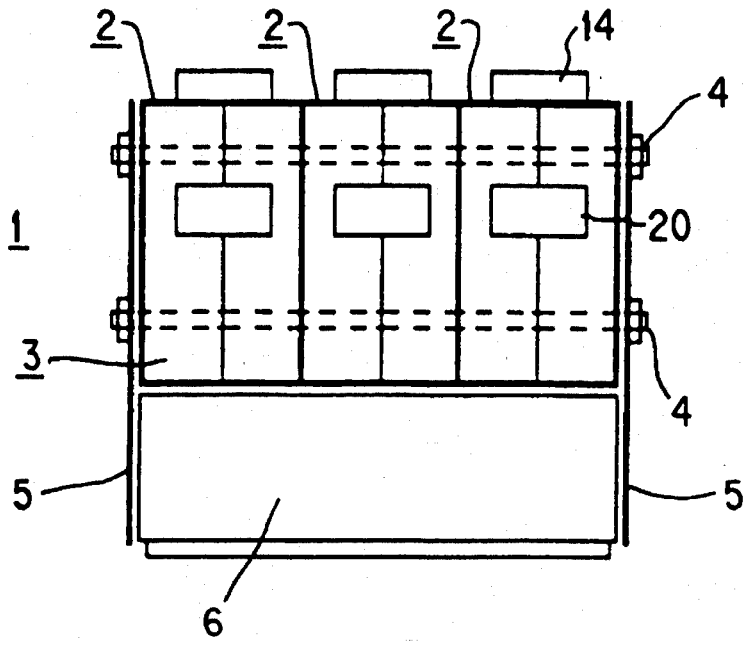
FIG. 1 illustrates a diagrammatic, plan view of a multipole vacuum switch.

The vacuum switch 1 shown in FIG. 1 is of a three pole design and has three pole units 2 which are arranged one next to the other without spacing. The pole block 3 which is formed in this way is held together by tensioning bolts 4 which penetrate the pole units 2 and at the same time also grip side walls 5 which form the lateral termination of the pole block 3 and which are designed to protrude beyond the pole block 3. Between the protruding sections of the side walls 5 there is a drive device 6 which serves in a known manner for switching on and off the vacuum interrupters contained in the pole units 2.

Details of one of the pole units 2 are explained in greater detail below with reference to FIGS. 2 to 5. First, the basic design is described with reference to FIG. 2 and FIG. 3.

The pole unit 2 has a vacuum interrupter 10 which has a housing 11 with an upper end flange 12 and a lower end flange 13. The lower end flange 13 forms at the same time the one connection point of the vacuum interrupter 10. A connection bar 14 which is bent at a right angle is provided as a connection device. A displaceably mounted connection bolt 15 to which the one leg 16 of a flexible strip conductor 17 is attached extends through the upper terminating flange 12. The strip conductor 17 is approximately loop-shaped and has a shorter leg 18 which is located opposite and approximately parallel to the leg 16 and to which a straight connection bar 20 is connected. The connection bar 20 extends upwards parallel to the extension of the longitudinal axis of the vacuum interrupter 10 while the legs of the strip conductor 17 are arranged running transversely with respect to this longitudinal axis.

The components described above form the current path of the pole unit 2. This current path is contained in an insulation assembly 23 formed from two approximately shell-shaped insulating elements 21 and 22. First, the shape of the insulating element 22 will be explained in greater detail with reference to FIG. 4 and FIG. 5.

Figure 5:
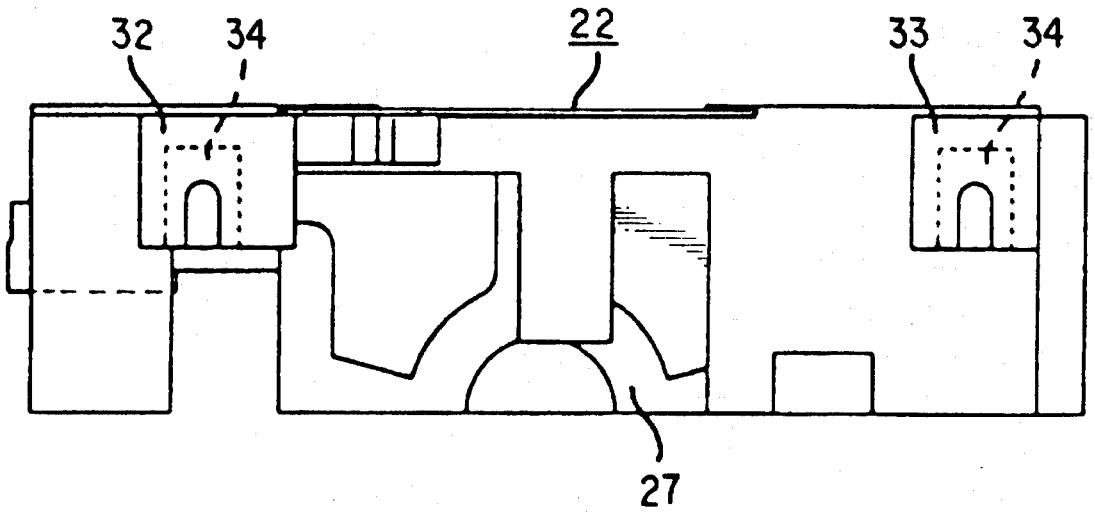
FIG. 5 illustrates the insulating element according to FIG. 4 from above.
Figure 4:
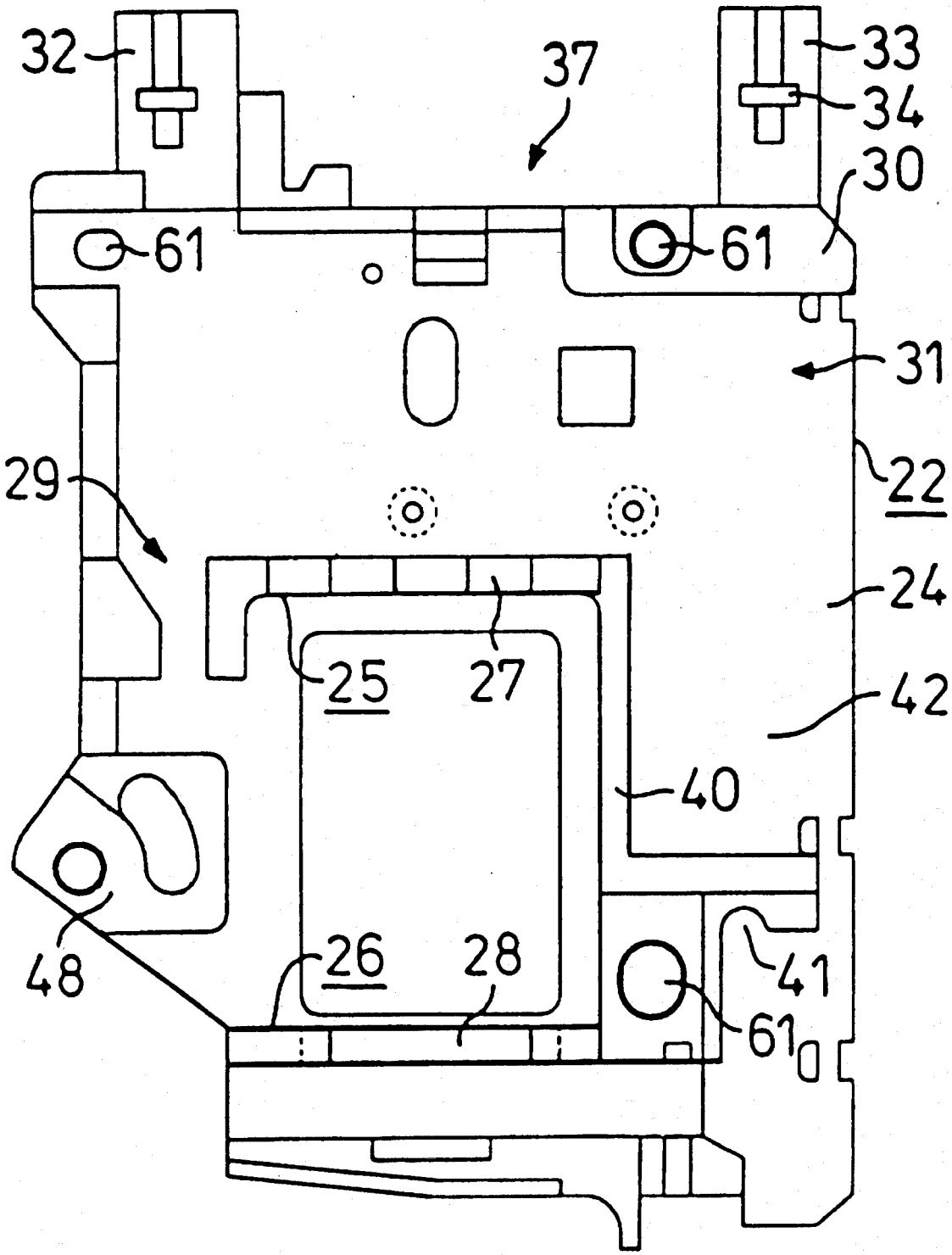
FIG. 4 illustrates one of the shell-like insulating elements from which the insulating arrangement of the pole unit according to FIG. 2

As can be seen from FIG. 4 and FIG. 5, the insulating element 22 has wall sections which project out of an essentially planar wall component 24 and by means of which a number of spaces or chambers are formed. Two wall sections 25 and 26 are provided here with approximately semicircular recesses 27 and 28 which are matched to the shape of the end flanges 12 and 13 of the vacuum interrupter 10. By means of the wall sections 25 and 26, in conjunction with corresponding wall sections of the associated mirror-inverted insulating element 21, a space for receiving the vacuum interrupter 10 is formed. If both semicircular recesses are dimensioned to match the end flanges 12 and 13, the vacuum interrupter 10 is clamped tight at both ends. In contrast, if it is desired to secure only one end, for example the end flange 12, of the vacuum interrupter 10, the recess 28 can be of a widened design, as is shown by broken lines in FIG. 4.

Figure 2:
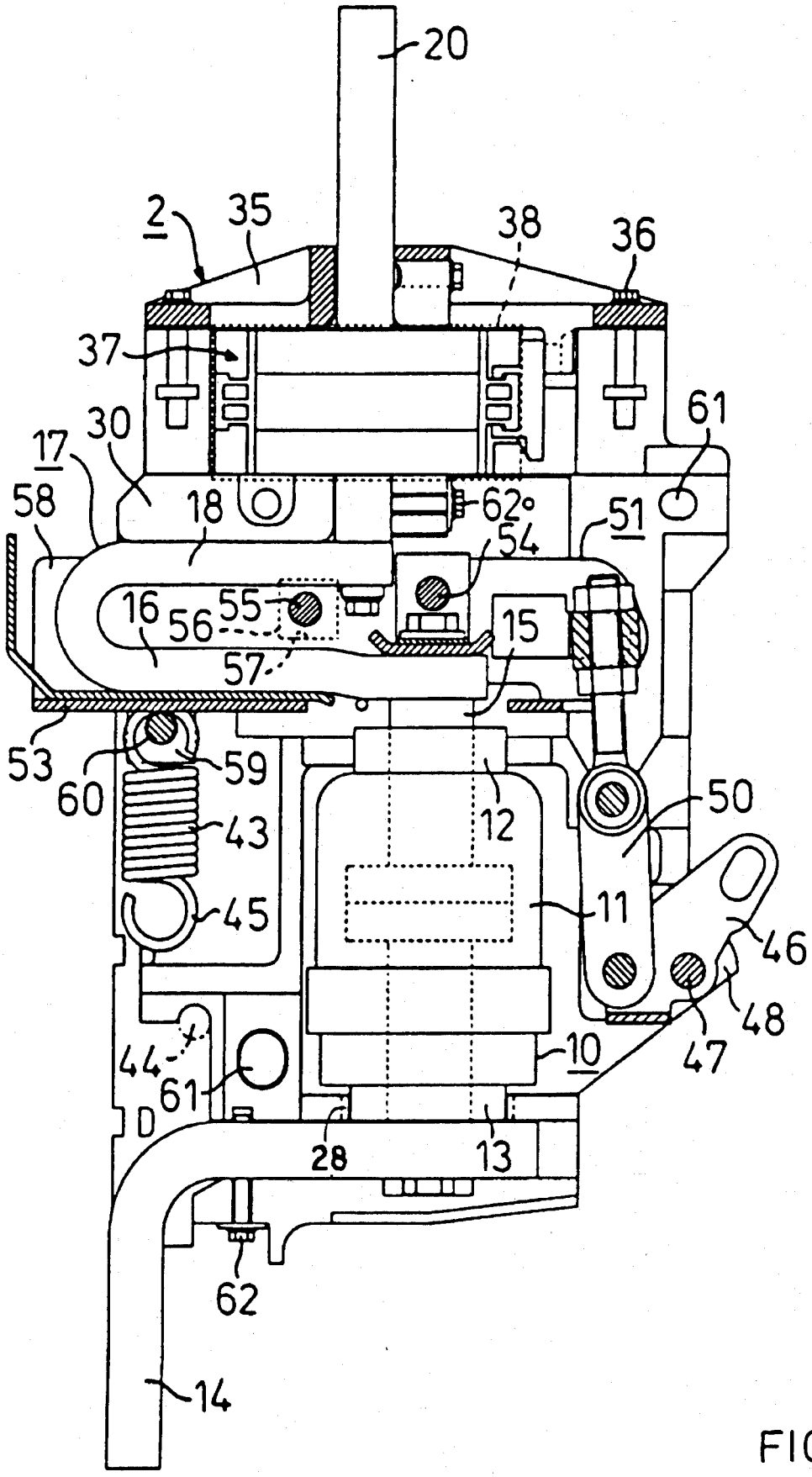
FIG. 2 illustrates a pole unit of the multipole vacuum switch according to FIG. 1 in the closed state.
Figure 3:
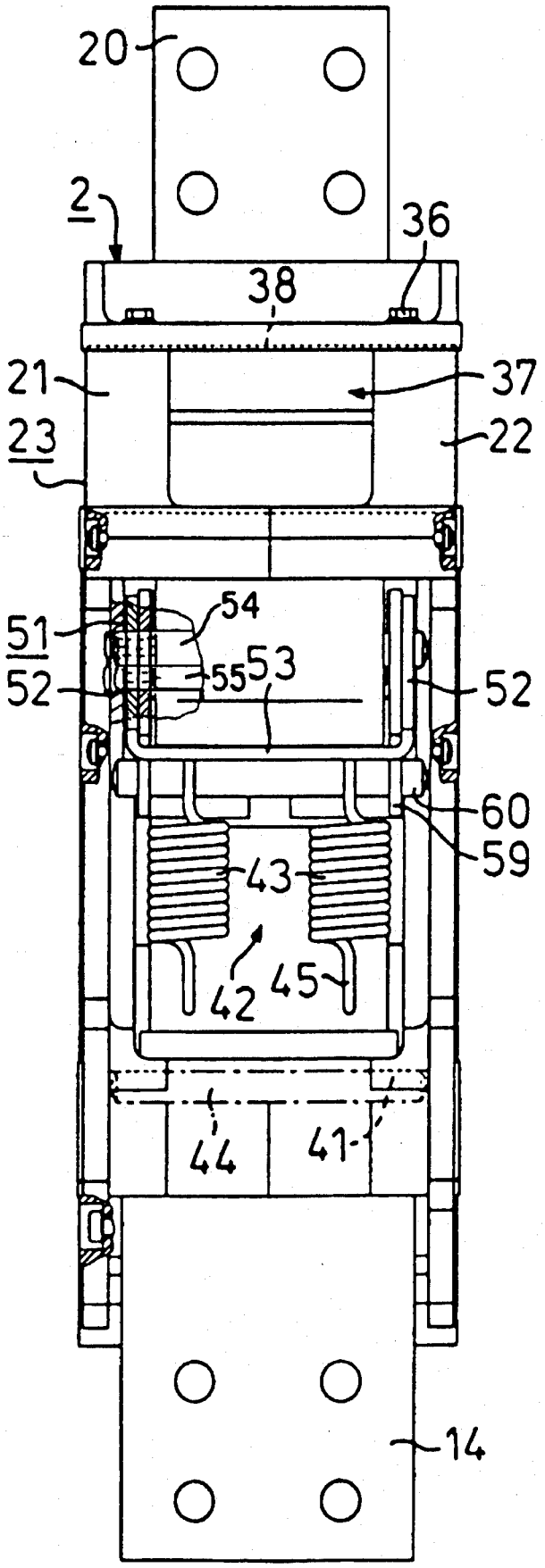
FIG. 3 is a view of one of the narrow sides of the pole unit according to FIG. 2 in the closed state.

A further wall section 30 which is arranged approximately parallel to the wall section 25 bounds a connection chamber 31 which is provided for receiving the flexible strip conductor 17 shown in FIG. 2. Towards the bottom, the connection chamber 31 is connected to a drive chamber 29 which is located to the side of the vacuum interrupter 10. Upper wall components 32 and 33 extend approximately parallel to the longitudinal axis of the vacuum switching chamber 10 (FIG. 2) and each contain a recess 34 for inserting a nut. FIG. 2 and FIG. 3 show that by fitting on a closure element 35 which extends beyond the entire width of the insulation assembly 23 and is connected to the insulating elements 21 and 22 via a total of four attachment screws 36, a measurement chamber 37 is formed in which a current transformer 38 whose contours are shown by a broken line can be accommodated. The wall section 30 and the closure element 35 have flush openings for the aforementioned upper connection bar 20 to pass through.

In addition, FIG. 4 shows on the right-hand side of the space which is provided for receiving the vacuum interrupter an angular wall section 40 on whose underside an undercut 41 is located. As a result, a spring chamber 42 is formed which serves, in accordance with FIG. 2 and FIG. 3, to receive two contact springs 43. The contact springs 43 are shown in the untensioned state, such as results after the installation of the current path and the connection of the movable connection bolt 15 to parts which will be explained later. The pretensioning of the contact springs 43 which is required for operation is brought about by inserting a bolt 44, indicated by dot-dashed lines, into lower eyelets 45 of the two contact springs 43 and of hooking this bolt into the undercuts 41 of both associated insulating elements 21 and 22. In addition, it is assumed in FIG. 2 and FIG. 3 that the drive parts are free of forces and therefore the vacuum interrupter 10 is under the influence of atmospheric air pressure in the switched-on state.

The drive device 6 which is shown diagrammatically in FIG. 1 interacts, according to FIG. 2, with in each case one coupling lever 46 of each of the pole units 2. The coupling lever 46 is pivotably mounted on a bolt 47 (FIG. 2) which engages at both ends in bearing eyes 48 of the insulating elements 21 and 22. One of the bearing eyes 48 is shown in FIG. 4. An adjustable coupling rod 50 which extends approximately parallel to the longitudinal axis of the vacuum interrupter 10 is located in the drive chamber 29 and connects the coupling lever 46 to a drive lever 51 located in the connection chamber 31. The drive lever 51 is formed by an approximately U-shaped sheet-metal part and has legs 52 and a central part 53 which does not need to extend beyond the entire length of the legs 52. The drive lever 51 is mounted by means of a bearing bolt 54 on the displaceable connection bolt 15. A further articulation bolt 55 extends through the legs 52 and engages in one window-like recess 56 which is shown by broken lines and whose lower edge forms a stop face 57 for the articulation bolt 55. An end part 58, which protrudes beyond the articulation bolt 55, of the drive lever 51 serves as a counter bearing for the aforesaid contact springs 43, specifically either directly or by means of the illustrated clips 59 in conjunction with a bolt 60 which connects the clips 59.

The flexible strip conductor 17 is located essentially completely between the legs 52 of the drive lever 51 and is in this way accommodated in a very space-saving manner. The desired function is achieved in that the lower leg 16 of the strip conductor 17 can be supported against the central part 53 while the upper leg 18 rests against the wall section 30. A force which spreads apart the legs 16 and 18 of the strip conductor 17 and is dependent on the respective current flowing therefore presses the drive lever 51 downwards in such a way that the contact force of the vacuum interrupter 10 is increased.

In the switched-on state, the articulation bolt 55 is at a specific distance from the stop face 57 so that the bearing bolt 54 forms the pivot bearing of the drive lever 51. If the drive device 6 (FIG. 1) is released for the purpose of switching off, which corresponds to the coupling lever 46 being released, the right-hand end, connected to the coupling rod 50, of the drive lever 51 is no longer secured. The drive lever 51 then pivots about its bearing bolt 54 in a counter clockwise direction until the articulation bolt 55 comes to rest against the stop face 57 and the stop face 57 now forms the pivot bearing of the drive lever 51. The contact springs 43 now act in an opening fashion with the lever arm of the end part 58 of the drive lever 51. The use of springs in such a way that they act both as contact springs and as switch-off springs is known per se in vacuum switches and can be found in German Patent Document No. DE-A-34 14 016.

For the purpose of receiving the tensioning bolts 4 shown in FIG. 1, the insulating elements 21 and 22 are provided with flush continuous openings 61. The insulating elements 21 and 22 are held together by means of connecting screws 62 before being ultimately connected by means of the tensioning bolts 4, the connecting screws 62 penetrating the wall sections of the insulating elements 21 and 22 and engaging in the connection bars 14 and 20.

As is clear from the description above, the use of the insulating elements permits a very space-saving arrangement of vacuum interrupters including their associated assemblies. At the same time, the loop-shaped strip conductor is integrated into the drive parts virtually without additional space being required. Therefore, the present invention is particularly suitable for the construction of compact switching devices, e.g. for circuit breakers in the voltage range of up to 1000 V, in particular in three pole or four pole designs.

What is claimed is:

1. A vacuum switch comprising:

a vacuum interrupter having a displaceable contact support rod which is a conductive electrode;

a drive device; and a lever arrangement cooperating with the vacuum interrupter and connecting the drive device to the vacuum interrupter, the lever arrangement having a two-armed drive lever which is connected in an articulated fashion to the displaceable contact support rod and on one side of the displaceable contact support rod is connected to the drive device and interacts on the other side of the displaceable contact support rod with a fixed support, a contact spring and a current-loop assembly, formed from a flexible strip conductor, wherein the fixed support is designed as a stop face against which the drive lever can be supported by the contact spring, the contact spring being designed as a tension spring and being arranged between an end part, protruding beyond the fixed support stop face, and wherein a first leg of the flexible strip conductor is connected to the displaceable contact support rod and is arranged to rest in a force-transmitting manner on the drive lever including its end part while a second leg of the strip conductor rests against a wall section of insulating elements between which the vacuum interrupter is accommodated, wherein a force which spreads apart the first leg and the second leg of the strip conductor and is dependent on a current flowing through the strip conductor presses the drive lever in such a way that the contact force of the vacuum interrupter is increased.

2. The vacuum switch as claimed in claim 1, wherein the drive lever has two legs which receive the strip conductor between them and a central part which connects the two legs of the drive lever and serves as a support face for supporting the first leg of the strip conductor connected to the contact support rod.

* * * * *